US006036038A

United States Patent [19]

Lovelace et al.

[11] Patent Number: 6,036,038

[45] Date of Patent: Mar. 14, 2000

[54] FOOD PACKAGING SYSTEM INCLUDING CONTENT LIFTING INSERT

[76] Inventors: Diane H. Lovelace; Barbara H. Duncan, both of 80 Hawthorne Rd., Grosse Pointe, Mich. 48236

[21] Appl. No.: 09/095,526

[22] Filed: Jun. 10, 1998

[51] Int. Cl.[7] ..... B65D 83/00; B65D 25/38

[52] U.S. Cl. ..... 215/391; 426/112; 426/115; 426/124; 206/804; 220/735; 210/470

[58] Field of Search ..... 426/115, 124, 426/112, 106, 398, 394, 131; 206/804, 817; 215/391; 220/212.5, 735; 210/470

[56] References Cited

U.S. PATENT DOCUMENTS

| | | | |
|---|---|---|---|
| 522,693 | 7/1894 | McLaughlin . | |
| 642,262 | 1/1900 | Sarles | 426/115 |
| 1,155,447 | 10/1915 | Saunders | 206/804 |
| 1,468,152 | 9/1923 | Hemstreet | 426/115 |
| 2,189,565 | 2/1940 | Jones | 210/155 |
| 2,281,251 | 4/1942 | Simmons | 206/804 |
| 2,334,595 | 11/1943 | Bailey | 426/115 |
| 2,605,187 | 7/1952 | Stiehm | 426/124 |
| 2,618,563 | 11/1952 | Barnhard | 426/124 |
| 2,628,914 | 2/1953 | Stiehm | 426/115 |
| 2,904,205 | 9/1959 | Callery | 426/124 |
| 3,004,657 | 10/1961 | Hyman | 426/112 |
| 3,040,897 | 6/1962 | Holman | 426/115 |
| 3,237,549 | 3/1966 | Pospischil | 426/115 |
| 3,249,250 | 5/1966 | McKee | 426/124 |
| 3,289,850 | 12/1966 | Gubash | 210/470 |
| 3,363,794 | 1/1968 | Dearing | 215/391 |
| 3,380,376 | 4/1968 | Preis | 99/413 |
| 3,380,592 | 4/1968 | Arnold | 426/115 |
| 3,392,845 | 7/1968 | Shapiro ett al. | 210/470 |
| 3,417,862 | 12/1968 | Fong | 426/115 |
| 4,052,934 | 10/1977 | Shinman | 99/355 |
| 4,179,040 | 12/1979 | Bateman et al. | 426/115 |
| 4,416,387 | 11/1983 | D'Antonio | 426/124 |
| 4,684,042 | 8/1987 | Strickler et al. | 426/124 |
| 5,626,266 | 5/1997 | Michelson | 426/124 |
| 5,634,569 | 6/1997 | DeCoster | 220/735 |
| 5,868,266 | 2/1999 | Nobakht | 206/804 |

FOREIGN PATENT DOCUMENTS

| | | | |
|---|---|---|---|
| 109386 | 3/1939 | Australia | 426/115 |
| 2711358 | 4/1995 | France . | |
| 2752227 | 2/1998 | France . | |
| 2243819 | 11/1991 | United Kingdom | 206/804 |

*Primary Examiner*—Steve Weinstein
*Attorney, Agent, or Firm*—Joseph N. Breaux

[57] ABSTRACT

A food packaging system that includes a jar with a mouth opening and a food holding chamber, a screw on lid that is securable over the mouth opening of the jar, and a resilient cupped lifting basket assembly that is positionable within a food holding chamber of the jar. The resilient cupped lifting basket assembly includes a resilient, cupped shaped, molded plastic, basket element and a rigid rectangular cross-sectional, grasping rod. The resilient, cupped shaped, molded plastic, basket element has a resiliently flexible, raised circumferential lip, a plurality of drain holes formed entirely therethrough and a centrally positioned rod connecting disk. The system optionally includes at least one resilient, cup shaped lifting attachment. Each lifting attachment has a number of drain apertures provided therethrough, a resilient, flexible circumferential attachment lip, a central rectangular shaped grasping rod insertion opening formed through a center thereof, and a diameter greater than the predetermined diameter of the resilient, cupped shaped, basket element. The central rectangular shaped grasping rod insertion opening is sized to restrict rotation of the lifting attachment about the rectangular cross sectioned grasping rod.

2 Claims, 3 Drawing Sheets

FOOD PACKAGING SYSTEM INCLUDING CONTENT LIFTING INSERT

TECHNICAL FIELD

The present invention relates to food packaging systems and more particularly to a food packaging system for preserved items such as olives, cherries and the like that includes a jar with a mouth opening and a food holding chamber, a screw on lid that is securable over the mouth opening of the jar, and a resilient cupped lifting basket assembly that is positionable within a food holding chamber of the jar; the resilient cupped lifting basket assembly including a resilient, cupped shaped, molded plastic, basket element and a rigid rectangular cross-sectional, grasping rod; the resilient, cupped shaped, molded plastic, basket element having a resiliently flexible, raised circumferential lip, a plurality of drain holes formed entirely therethrough and a centrally positioned rod connecting disk; the rigid rectangular cross-sectional, grasping rod having a rigid rectangular cross-sectional, grasping rod section extending vertically from an upper face of the central rod connecting disk and terminating at a far end in a grasping ring; the mouth opening being of a first predetermined diameter; the food holding chamber being of a second predetermined diameter and a first predetermined height; the second predetermined diameter being at least equal to the first predetermined diameter; the rigid grasping rod being of a second predetermined height less than the first predetermined height of the food holding chamber; the resiliently flexible raised circumferential lip of the resilient, cupped shaped, basket element being of a third predetermined diameter and of sufficient flexibility to allow insertion of the resilient, cupped shaped, basket element through the mouth opening of the jar and into the food holding chamber; the food packaging system optionally including at least one resilient, cup shaped lifting attachment; each lifting attachment having a number of drain apertures provided therethrough, a resilient, flexible circumferential attachment lip, a central rectangular shaped grasping rod insertion opening formed through a center thereof, and a diameter greater than the third predetermined diameter of the resilient, cupped shaped, basket element; the central rectangular shaped grasping rod insertion opening being sized to restrict rotation of the lifting attachment about the rectangular cross sectioned grasping rod.

BACKGROUND ART

Olives, cherries and other small food items, such as pickles, are sometimes packaged in glass jars with reclosable screw on lids. Although this packaging modality provides a convenient reclosable package that allows the user to consume only a portion of the package contents at one time, a user must often find a utensil or resort to using his/her fingers to remove one or more of the food items from the food holding compartment of a partially filled jar. It would be a benefit, therefore, to have a packaging system for packing olives and other small items that included a lifting basket positioned within the food holding chamber of the jar prior to introducing the food items and that includes a grasping rod that extended upward to the mouth of the jar so as to eliminate the need for retrieving a utensil, such as a spoon or fork, or the unsanitary practice of fishing the food item out with fingers each time a food item is to be removed.

GENERAL SUMMARY DISCUSSION OF INVENTION

It is thus an object of the invention to provide a food packaging system that includes a lifting basket positioned within the food holding chamber of a jar prior that has a grasping rod that extends upward to the mouth of the jar.

It is a further object of the invention to provide a food packaging system that includes a jar with a mouth opening and a food holding chamber, a screw on lid that is securable over the mouth opening of the jar, and a resilient cupped lifting basket assembly that is positionable within a food holding chamber of the jar; the resilient cupped lifting basket assembly including a resilient, cupped shaped, molded plastic, basket element and a rigid rectangular cross-sectional, grasping rod; the resilient, cupped shaped, molded plastic, basket element having a resiliently flexible, raised circumferential lip, a plurality of drain holes formed entirely therethrough and a centrally positioned rod connecting disk; the rigid rectangular cross-sectional, grasping rod having a rigid rectangular cross-sectional, grasping rod section extending vertically from an upper face of the central rod connecting disk and terminating at a far end in a grasping ring; the mouth opening being of a first predetermined diameter; the food holding chamber being of a second predetermined diameter and a first predetermined height; the second predetermined diameter being at least equal to the first predetermined diameter; the rigid grasping rod being of a second predetermined height less than the first predetermined height of the food holding chamber; the resiliently flexible raised circumferential lip of the resilient, cupped shaped, basket element being of a third predetermined diameter and of sufficient flexibility to allow insertion of the resilient, cupped shaped, basket element through the mouth opening of the jar and into the food holding chamber.

It is a still further object of the invention to provide a food packaging system as just described that optionally includes at least one resilient, cup shaped lifting attachment; each lifting attachment having a number of drain apertures provided therethrough, a resilient, flexible circumferential attachment lip, a central rectangular shaped grasping rod insertion opening formed through a center thereof, and a diameter greater than the third predetermined diameter of the resilient, cupped shaped, basket element; the central rectangular shaped grasping rod insertion opening being sized to restrict rotation of the lifting attachment about the rectangular cross sectioned grasping rod.

It is a still further object of the invention to provide a food packaging system that accomplishes both of the above objects in combination.

Accordingly, a food packaging system is provided. The food packaging system includes a jar with a mouth opening and a food holding chamber, a screw on lid that is securable over the mouth opening of the jar, and a resilient cupped lifting basket assembly that is positionable within a food holding chamber of the jar; the resilient cupped lifting basket assembly including a resilient, cupped shaped, molded plastic, basket element and a rigid rectangular cross-sectional, grasping rod; the resilient, cupped shaped, molded plastic, basket element having a resiliently flexible, raised circumferential lip, a plurality of drain holes formed entirely therethrough and a centrally positioned rod connecting disk; the rigid rectangular cross-sectional, grasping rod having a rigid rectangular cross-sectional, grasping rod section extending vertically from an upper face of the central rod connecting disk and terminating at a far end in a grasping ring; the mouth opening being of a first predetermined diameter; the food holding chamber being of a second predetermined diameter and a first predetermined height; the second predetermined diameter being at least equal to the first predetermined diameter; the rigid grasping rod being of a second predetermined height less than the first predetermined height of the food holding chamber; the resiliently flexible raised circumferential lip of the resilient, cupped shaped, basket element being of a third predetermined diameter and of sufficient flexibility to allow insertion of the resilient, cupped shaped, basket element through the mouth opening of the jar and into the food holding chamber.

In a preferred embodiment the food packaging system further includes at least one resilient, cup shaped lifting attachment; each lifting attachment having a number of drain apertures provided therethrough, a resilient, flexible circumferential attachment lip, a central rectangular shaped grasping rod insertion opening formed through a center thereof, and a diameter greater than the third predetermined diameter of the resilient, cupped shaped, basket element; the central rectangular shaped grasping rod insertion opening being sized to restrict rotation of the lifting attachment about the rectangular cross sectioned grasping rod.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
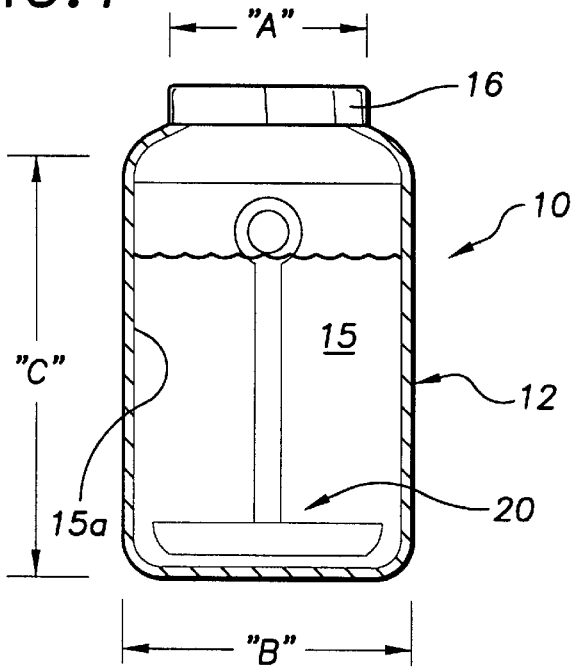
FIG. 1 is a perspective view of a first exemplary embodiment of the food packaging system of the present invention showing the jar with the mouth opening, the screw on lid secured over the mouth opening of the jar, and the resilient cupped lifting basket assembly positioned within the food holding chamber of the jar.

FIG. 1 shows a first exemplary embodiment of the food packaging system of the present invention, generally designated by the numeral 10. Food packaging system 10 includes a glass jar, generally designated 12, having a mouth opening 14 (FIG. 2) and a food holding chamber 15 in connection with mouth opening 14; a screw on lid 16 that is threadably securable onto the threads 18 (FIG. 2) surrounding mouth opening 14 of jar 12; and a one-piece, molded plastic resilient cupped lifting basket assembly, generally designated 20, positionable within food holding chamber 15 of jar 12. Food holding chamber 15 is defined by an holding chamber jar wall 15*a*.

In this embodiment, mouth opening 14 (FIG. 2) has a diameter "A" of three inches (3") and food holding chamber 15 has a diameter "B" of three and one-half inches (3½") and a height "C" of six inches (6").

Figure 2:
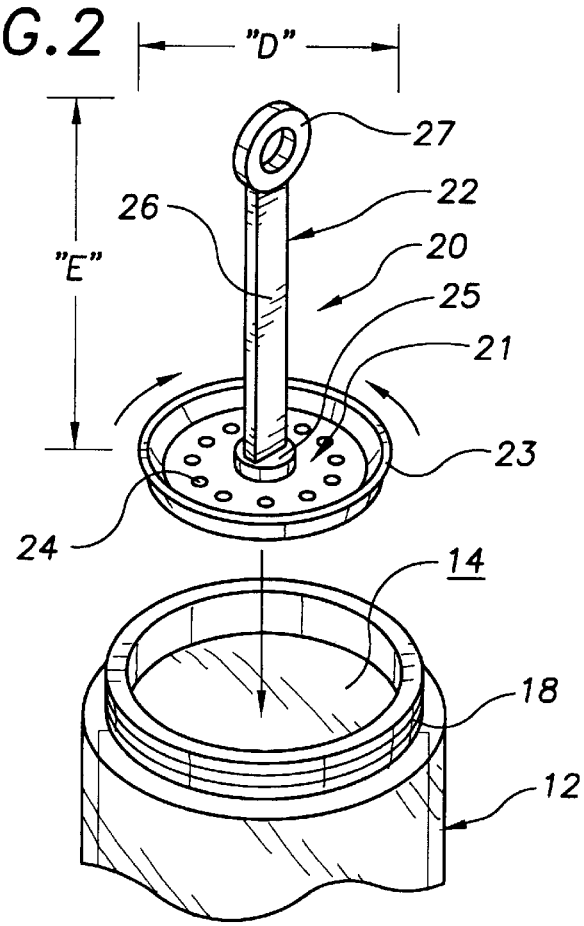
FIG. 2 is a perspective view of the exemplary embodiment of the resilient cupped lifting basket assembly of the exemplary food packaging system of FIG. 1 positioned above the mouth opening of the jar showing the resilient, cupped shaped, molded plastic, basket element including the resiliently flexible raised circumferential lip and the central rod connecting disk; and the rigid rectangular cross-sectional, grasping rod extending vertically from the upper face of the central rod connecting disk and terminating at a far end in a grasping ring.

With reference to FIG. 2, resilient cupped lifting basket assembly 20 is of molded plastic construction and includes a resilient, cupped shaped, molded plastic, basket element, generally designated 21 and a grasping rod, generally designated 22 that are integrally formed. Basket element 21 includes a resiliently flexible raised circumferential lip 23, a plurality of drain holes 24 and a central rod connecting disk 25. Grasping rod 22 includes a rectangular cross-sectional grasping rod section 26 formed in connection at one end with rod connecting disk 25 and formed in connection with a circular grasping ring 27 at the opposite end thereof.

Figure 3:
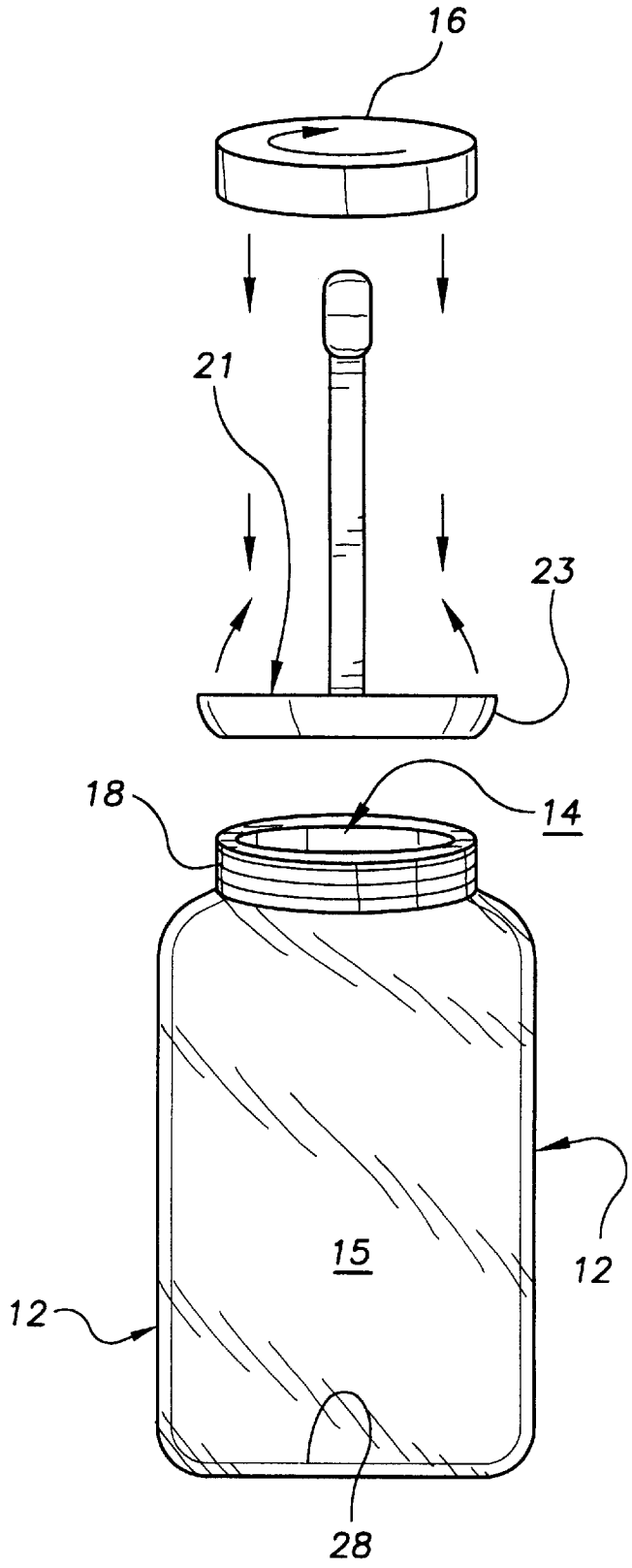
FIG. 3 is an exploded plan view of the first exemplary embodiment of the food packaging system of the present invention showing the jar with the mouth opening, the resilient cupped lifting basket assembly positioned above the mouth opening of the jar; and the screw on lid positioned above the grasping ring of the resilient cupped lifting basket assembly.

In this embodiment, basket element 21 has a diameter "D" of three and one-half inches (3½") and the combined height "E" of lifting basket assembly 20 is five and one-half inches (5½") to allow lifting basket assembly 20 to be fully contained within food holding chamber 15 (FIG. 3).

With continued reference to FIG. 3, resiliently flexible raised circumferential lip 23 is sufficiently flexible to allow basket element 21 to be inserted through the smaller diameter mouth opening 14 and forced down to the bottom 28 of food holding compartment 15 prior to filling food holding chamber 15 with food items, such as pickles, olives, cherries, or the like, and sealing jar 12 by attaching lid 16 in the conventional manner discussed herein above.

With general reference to FIGS. 1 and 2, in some situations, when the diameter "A" of mouth opening 14 is sufficiently less than the diameter "B" of food holding chamber 15, molded plastic, basket element 21 of resilient cupped lifting basket assembly 20 is not adequate to extend sufficiently toward holding chamber jar wall 15*a* to ensure lifting of all food items within food holding chamber 15 of jar 12 when resilient cupped lifting basket assembly 20 is lifted toward mouth opening 14 of jar 12.

Figure 4:
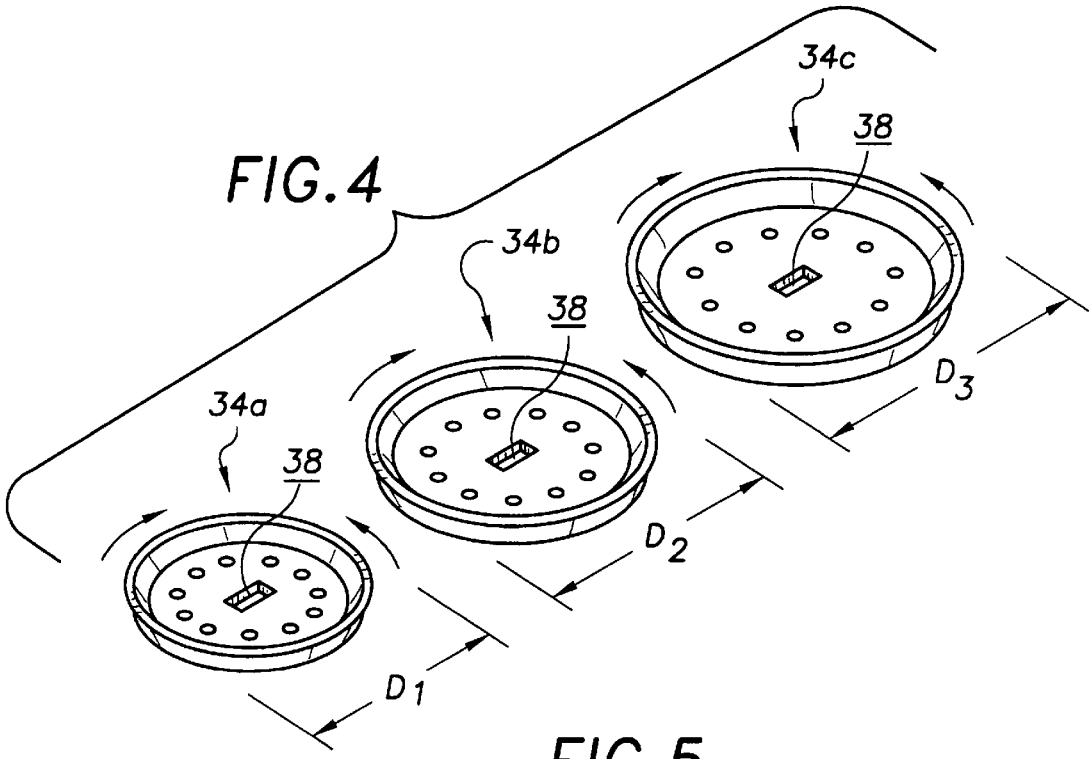
FIG. 4 is a perspective view showing three exemplary optional resilient, cup shaped lifting attachments, each having a central rectangular shaped grasping rod insertion opening, that are used when the diameter of the food holding chamber of the jar exceeds the diameter of the mouth opening of the jar to an extent that the diameter of the resilient, cupped shaped, molded plastic, basket element of the resilient cupped lifting basket assembly is not adequate to extend sufficiently toward the holding chamber sidewalls to ensure lifting of all food items within the food holding chamber of the jar when the resilient cupped lifting basket assembly is lifted toward the mouth opening of the jar.
Figure 5:
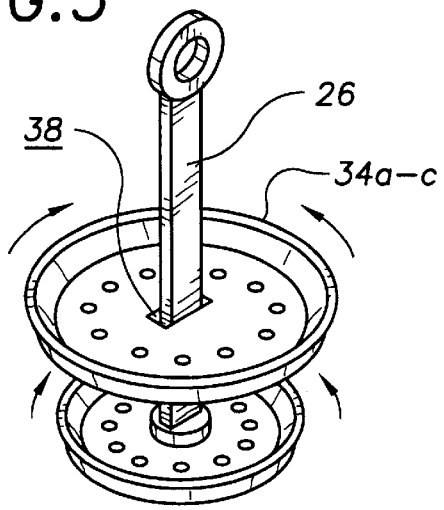
FIG. 5 is a perspective view showing the rigid plastic grasping rod inserted through central rectangular shaped grasping rod insertion opening of one of the optional, resilient, cup shaped lifting attachments.
Figure 6:
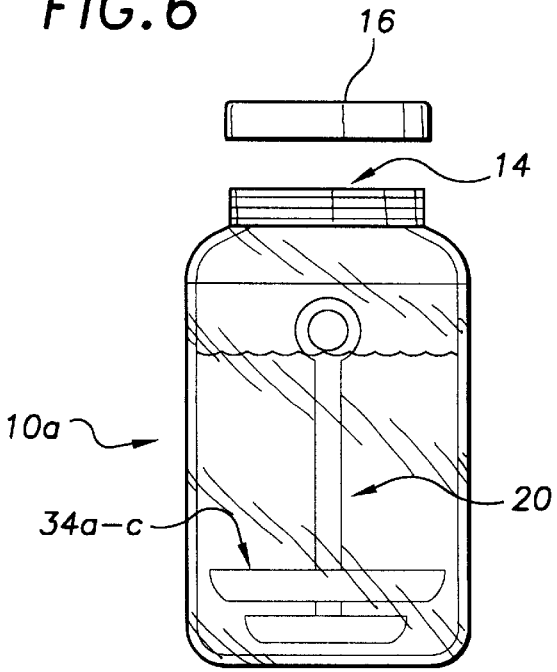
FIG. 6 is a side plan view of a second exemplary jar having a large diameter food holding chamber and a resilient cupped lifting basket assembly including an optional resilient, cup shaped lifting attachment mounted onto the rigid plastic grasping rod and positioned within the food holding chamber of the jar.

With reference now to FIG. 4, to remedy this deficiency, packaging system 10 can be provided with a selected optional resilient, cup shaped lifting attachment, generally designated 34*a–c*, having a selected diameter "$D_{1\text{-}3}$" that is selected to best approximate the diameter "B" of food holding chamber 15 (FIG. 1). Each lifting attachment 34*a–c* is identical except for relative proportions and each has a central rectangular shaped grasping rod insertion opening 38 that, with reference to FIG. 5, is sized to prevent lifting attachment from rotating about grasping rod section 26 when it is inserted through insertion opening 38. FIG. 6 shows an exemplary packaging system 10*a* including a glass jar 12; a screw on lid 1; a one-piece, molded plastic resilient cupped lifting basket assembly 20; and a lifting attachment 34*a–c*.

It can be seen from the preceding description that a food packaging system that has been provided that includes a lifting basket positioned within the food holding chamber of a jar prior that has a grasping rod that extends upward to the mouth of the jar; that includes a jar with a mouth opening and a food holding chamber, a screw on lid that is securable over the mouth opening of the jar, and a resilient cupped lifting basket assembly that is positionable within a food holding chamber of the jar; the resilient cupped lifting basket assembly including a resilient, cupped shaped, molded plastic, basket element and a rigid rectangular cross-sectional, grasping rod; the resilient, cupped shaped, molded plastic, basket element having a resiliently flexible, raised circumferential lip, a plurality of drain holes formed entirely therethrough and a centrally positioned rod connecting disk; the rigid rectangular cross-sectional, grasping rod having a rigid rectangular cross-sectional, grasping rod section extending vertically from an upper face of the central rod connecting disk and terminating at a far end in a grasping ring; the mouth opening being of a first predetermined diameter; the food holding chamber being of a second predetermined diameter and a first predetermined height; the second predetermined diameter being at least equal to the first predetermined diameter; the rigid grasping rod being of a second predetermined height less than the first predetermined height of the food holding chamber; the resiliently flexible raised circumferential lip of the resilient, cupped shaped, basket element being of a third predetermined diameter and of sufficient flexibility to allow insertion of the resilient, cupped shaped, basket element through the mouth opening of the jar and into the food holding chamber; and a food packaging system that optionally includes at least one resilient, cup shaped lifting attachment; each lifting attachment having a number of drain apertures provided therethrough, a resilient, flexible circumferential attachment lip, a central rectangular shaped grasping rod insertion opening formed through a center thereof, and a diameter greater than the third predetermined diameter of the resilient, cupped shaped, basket element; the central rectangular shaped grasping rod insertion opening being sized to restrict rotation of the lifting attachment about the rectangular cross sectioned grasping rod.

It is noted that the embodiment of the food packaging system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A food packaging system comprising:

a jar with a mouth opening and a food holding chamber;

a screw on lid that is securable over said mouth opening of said jar;

a resilient cupped lifting basket assembly that is positionable within said food holding chamber of said jar; and at least one resilient, cup shaped lifting attachment;

said resilient cupped lifting basket assembly including a resilient, cupped shaped, molded plastic, basket element and a rigid grasping rod;

said resilient, cupped shaped, molded plastic, basket element having a resiliently flexible, raised circumferential lip, a plurality of drain holes formed entirely therethrough and a centrally positioned rod connecting disk;

said rigid grasping rod having a rigid grasping rod section extending vertically from an upper face of said central rod connecting disk;

said mouth opening being of a first predetermined diameter;

said food holding chamber being of a second predetermined diameter and a first predetermined height;

said second predetermined diameter being at least equal to said first predetermined diameter;

said rigid grasping rod being of a second predetermined height less than said first predetermined height of said food holding chamber;

said resiliently flexible raised circumferential lip of said resilient, cupped shaped, basket element being of a third predetermined diameter that is greater than said first predetermined diameter and of sufficient flexibility to allow insertion of said resilient, cupped shaped, basket element through said mouth opening of said jar and into said food holding chamber;

each said lifting attachment having a number of drain apertures provided therethrough, a resilient, flexible circumferential attachment lip, a central grasping rod insertion opening formed through a center thereof, and a diameter greater than said third predetermined diameter of said resilient, cupped shaped, basket element;

said grasping rod section has a predetermined cross-sectional shape; and said central grasping rod insertion opening is sized and shaped to restrict rotation of said lifting attachment about said grasping rod section.

2. The food packaging system of claim 1, wherein:

said grasping rod section has a rectangular cross-sectional shape; and said central grasping rod insertion opening is rectangular shaped and sized to restrict rotation of said lifting attachment about said grasping rod section.

* * * * *